United States Patent [19]

Beck

[11] Patent Number: 5,073,146

[45] Date of Patent: Dec. 17, 1991

[54] COMPRESSOR VALVING

[75] Inventor: Norman G. Beck, Sidney, Ohio

[73] Assignee: Copeland Corporation, Sidney, Ohio

[21] Appl. No.: 504,875

[22] Filed: Apr. 5, 1990

[51] Int. Cl.[5] ..... F04B 39/10

[52] U.S. Cl. ..... 417/571; 137/512.1

[58] Field of Search ..... 417/566, 567, 571; 277/235 B, 236; 137/512.1

[56] References Cited

U.S. PATENT DOCUMENTS

| | | | |
|---|---|---|---|
| 51,175 | 11/1865 | Guild . | |
| 1,453,912 | 5/1923 | Buckley et al. . | |
| 2,064,754 | 12/1936 | Ivens . | |
| 3,926,214 | 12/1975 | Hrabal . | |
| 4,630,835 | 12/1986 | Locacius | 277/235 B |
| 4,721,315 | 1/1988 | Ueta | 277/236 |
| 4,730,996 | 3/1988 | Akatsuchi et al. . | |
| 4,765,634 | 8/1988 | Kobayashi | 277/236 |
| 4,767,124 | 8/1988 | Udagawa | 277/235 B |
| 4,810,591 | 3/1989 | Sakai | 277/236 |
| 4,818,195 | 4/1989 | Murayama et al. . | |
| 4,854,839 | 8/1989 | DiFlora | 417/571 |
| 4,886,424 | 12/1989 | Ikeda et al. | 417/571 |
| 4,898,396 | 2/1990 | Udagawa | 277/235 B |
| 4,915,398 | 4/1990 | Kitagawa | 277/236 |

*Primary Examiner*—Richard A. Bertsch
*Assistant Examiner*—Michael I. Kocharov
*Attorney, Agent, or Firm*—Harness, Dickey & Pierce

[57] ABSTRACT

A refrigeration compressor is disclosed which incorporates an improved valve plate assembly having selected portions thereof bowed outwardly to form discrete raised surface portions thereon. These raised surface portions serve to initially increase the clamping force on the gasket means disposed between the valve plate and head or compressor housing to thereby insure a fluid tight seal is maintained during operation of the compressor. Further the valve plate assembly incorporates dual suction valves oriented in side by side relationship and secured to the valve plate at opposite ends. This arrangement offers improved gas flow to the compression chamber by substantially reducing competition between adjacent valves.

23 Claims, 3 Drawing Sheets

COMPRESSOR VALVING

BACKGROUND AND SUMMARY OF THE INVENTION

The present invention relates generally to refrigeration compressors and more particularly to an improved valve plate assembly for use in such compressors.

Refrigeration compressors of the reciprocating piston type generally incorporate a valve plate containing suction and discharge valves for controlling flow of refrigerant to and from one or more compression chambers. This valve plate is normally clamped between the compressor housing or block and the head. The head will generally include a suction chamber and discharge chamber communicating with the respective suction and discharge valves.

It is generally desirable to minimize the thickness of the valve plate so as to minimize the volume of the discharge passages extending therethrough. This is important because compressed gas remaining in these passages upon completion of the compressor stroke will reexpand thus reducing compressor volumetric efficiency. However, as the valve plate thickness is reduced, its ability to resist pressure and thermal deflections decreases thus giving rise to possible leakage of discharge gas from the compression chamber in the head to the suction chamber or between adjacent cylinders in multiple piston type machines. Thus, in order to insure fluid tight sealing of the valve plate with both the compressor housing and head, it has not been possible to minimize the thickness of the valve plate and has been necessary to utilize larger numbers of closely spaced fasteners to secure the head and valve plate to the housing and/or more complicated head designs to minimize the presence of sealing surfaces on the valve plate in areas where the opposite surface of the valve is not fully supported (i.e. over the cylinder bore for example).

In addition to the above, it is also desirable to insure ample flow area for suction gas to enter the compression chamber. In prior designs multiple elongated reed type suction valves are often utilized being positioned in parallel side by side relationship and secured to the valve plate at the same end thereof. In such an arrangement the maximum valve lift and hence maximum flow area for each valve will be in the same general area. Thus the neighboring suction passages will be competing with each other for suction gas flow. This competition has required that the spacing between such valves be increased thus leaving less area to accommodate discharge ports and associated valving, the length in which the suction valve overlaps the associated port be reduced, trepan valve seats be provided on the valve plate and/or suction port size be increased in order to insure adequate flow to the compression chamber.

The present invention, however, overcomes the above noted difficulties by providing an improved valve plate assembly which incorporates oppositely bowed portions which serve to initially increase the compressive loading on the gaskets in selected areas so as to insure and maintain a fluid tight seal. This arrangement enables the thickness of the valve plate to be reduced thus improving the compressor's volumetric efficiency. Further, greater freedom of design for the head is offered as a result of a reduction in the number of fasteners required for securing the head to the compressor housing. This reduction in the number of required fasteners also reduces the overall cost for parts and assembly labor.

Additionally, the present invention incorporates an improved suction valve assembly wherein a pair of reed type suction valves are secured to the valve plate at opposite ends of the valve members. This arrangement offers substantial improvement in the suction flow characteristics in that the maximum lift of each of the valves and hence maximum flow area therefor is at opposite ends of the two valves. Thus, the competition for flow between the adjacent valves is minimized and thus the spacing therebetween may be reduced, port size can be reduced and valve overlap can be increased.

Additional advantages and features of the present invention will become apparent from the subsequent description and the appended claims taken in conjunction with the accompanying drawings.

DESCRIPTION OF THE PREFERRED EMBODIMENT

Figure 1:
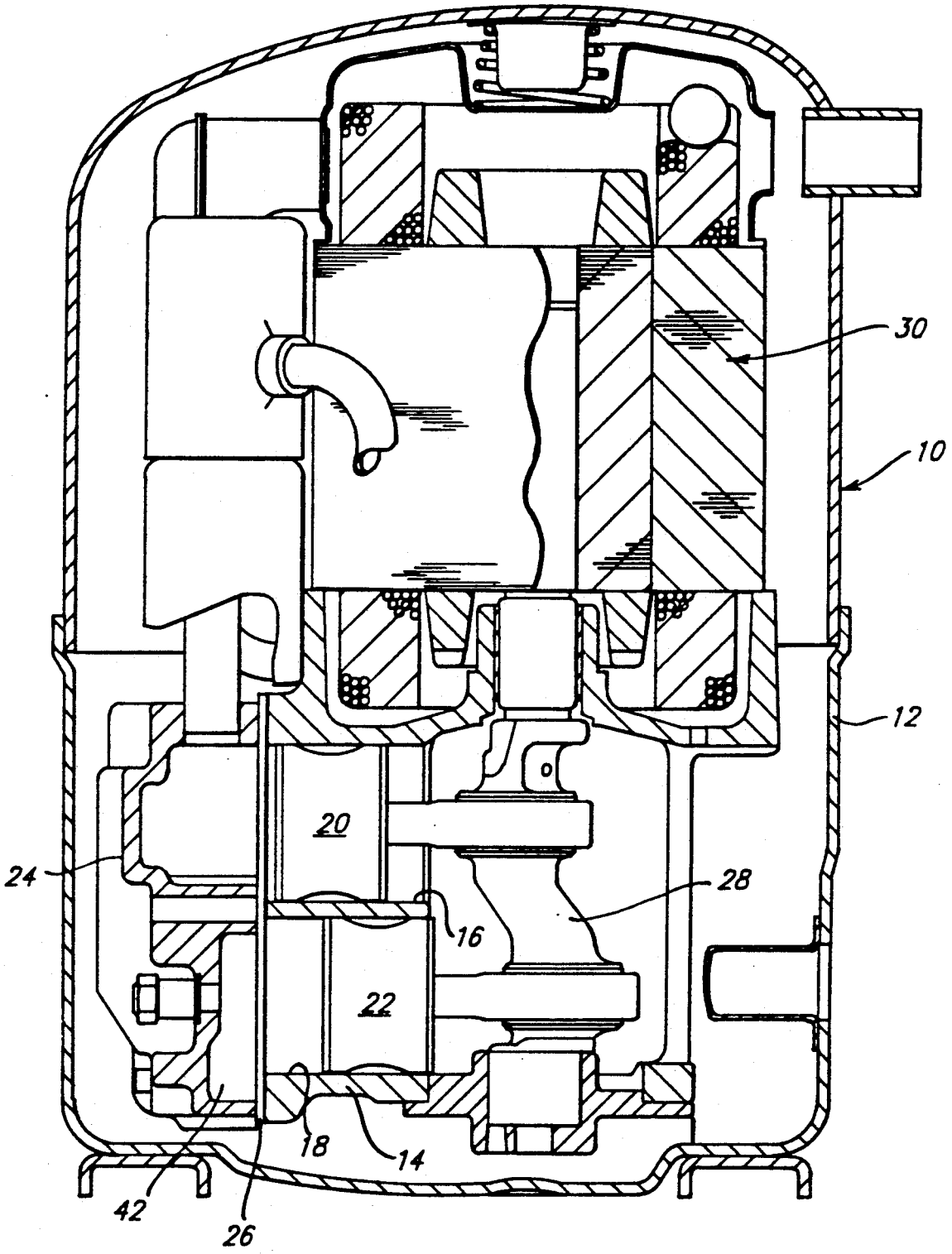
FIG. 1 is a section view of a hermetic refrigeration compressor of the reciprocating piston type in accordance with the present invention.

Referring now to the drawings and in particular to FIG. 1, there is shown a refrigeration compressor in accordance with the present invention generally indicated at 10. Refrigeration compressor 10 is of the hermetic reciprocating piston type and includes an outer shell 12 within which is disposed a compressor housing 14 having a pair of cylinder bores 16 and 18 provided therein in spaced side by side relationship within which pistons 20, 22 are reciprocatingly disposed. A head 24 is secured to compressor housing 14 with a valve plate assembly 26 being clamped therebetween. Pistons 20 and 22 are reciprocated by crankshaft 28 which in turn is rotatably driven by motor assembly 30.

Figure 2:
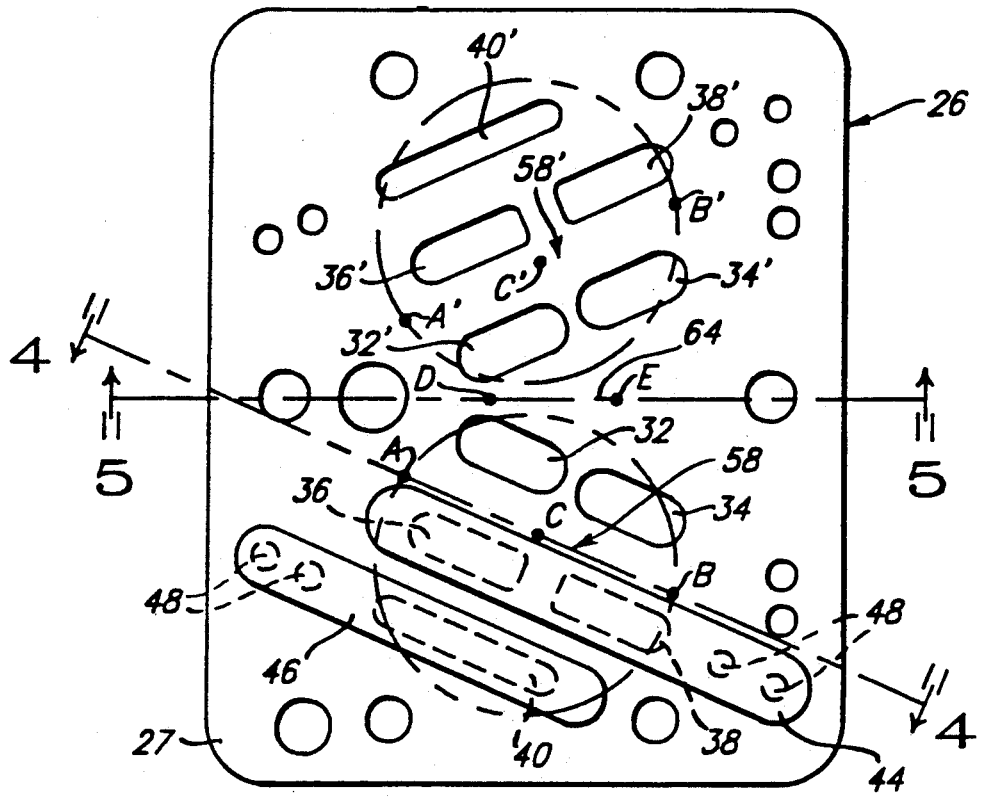
FIG. 2 is an enlarged plan view of a valve plate assembly incorporated in the refrigeration compressor of FIG. 1.

Referring now to FIG. 2, valve plate assembly 26 comprises a relatively thin plate member 27 suitably sized to overlie both cylinders 16 and 18 and to thereby control flow of refrigerant to and from the compression chambers defined by the pistons 20, 22 and respective cylinders 16, 18. To this end valve plate assembly includes a pair of spaced discharge passages 32, 34 and three suction passages 36, 38, 40 adapted to be positioned in overlying relationship to cylinder 16. A single reed type discharge valve (not shown) is secured to one side of valve plate 27 and operates to control flow from cylinder 16 to a discharge chamber 42 provided in head 24. A pair of elongated reed type suction valves 44, 46 are also secured to valve plate 27 in generally parallel spaced relationship with valve 44 overlying and controlling flow through passages 36, 38 and valve 46 controlling flow through passage 40. As shown in FIG. 2, while suction valves 44 and 46 are positioned in parallel side by side relationship, they are secured to plate 27 at opposite ends by means of suitable fasteners such as rivets 48. A second set of substantially identical suction and discharge ports indicated by like numbers primed and associated valving (not shown) is also provided being positioned in overlying relationship to cylinder 18.

It should be noted that this arrangement for securing the suction valves greatly improves the flow of suction gas into the respective cylinders 16 and 18 because the free ends of the two suction valves where maximum lift occurs and hence maximum gas flow occurs are located at opposite ends of the respective valves. Therefore flow competition therebetween is substantially eliminated. This improved suction gas flow thus enables the space between the suction valves to be reduced as well as allowing the length of the suction ports to be reduced. This allows more flexibility for positioning and sizing of the discharge ports. Additionally, shortening of the suction ports allows the tips of the valves to overlap the ports to a greater degree thereby reducing the energy required to open the valves as well as providing a cushioning effect as the valves close thus eliminating the need for trepan valve seats.

Figure 3:
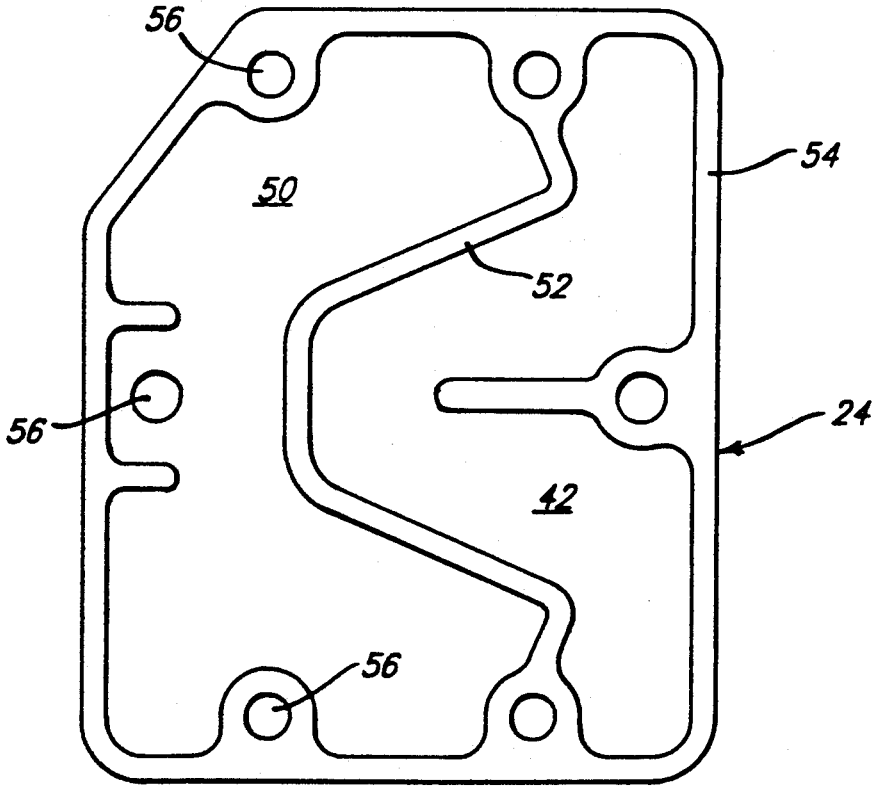
FIG. 3 is a plan view of the head of the refrigeration compressor of FIG. 1.

As best seen with reference to FIG. 3, head 24 includes a generally hollow interior which is divided into a discharge gas chamber 42 and a suction gas chamber 50 by means of wall 52 the outer edge of which is positioned in substantially coplanar relationship with the outer edge of peripheral flange portion 54. Suitable openings 56 are provided spaced around head 24 to accommodate fasteners for securing head 24 and valve plate 26 to compressor housing 14. It should be noted that discharge chamber 42 extends over both cylinders 16 and 18 and hence receives high pressure discharge gas via both sets of discharge passages 32, 34, 32', 34'. Similarly, suction chamber 50 extends over both cylinders and supplies low pressure suction gas to both sets of suction passages.

Figure 4:
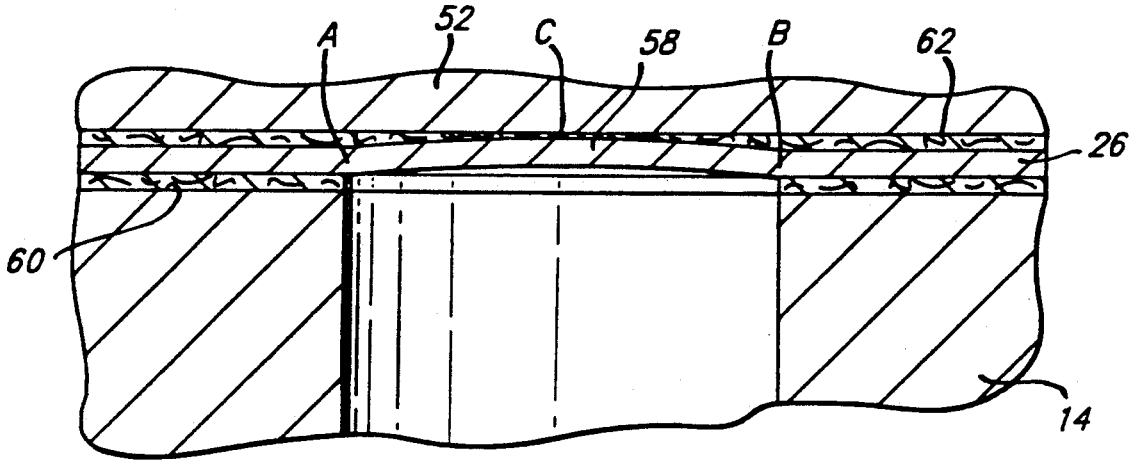
FIG. 4 is a section view of the valve plate assembly of FIG. 2 shown in operative relationship with portions of the head and compressor housing also shown in section, the section being taken along lines 4—4 of FIG. 2.
Figure 5:
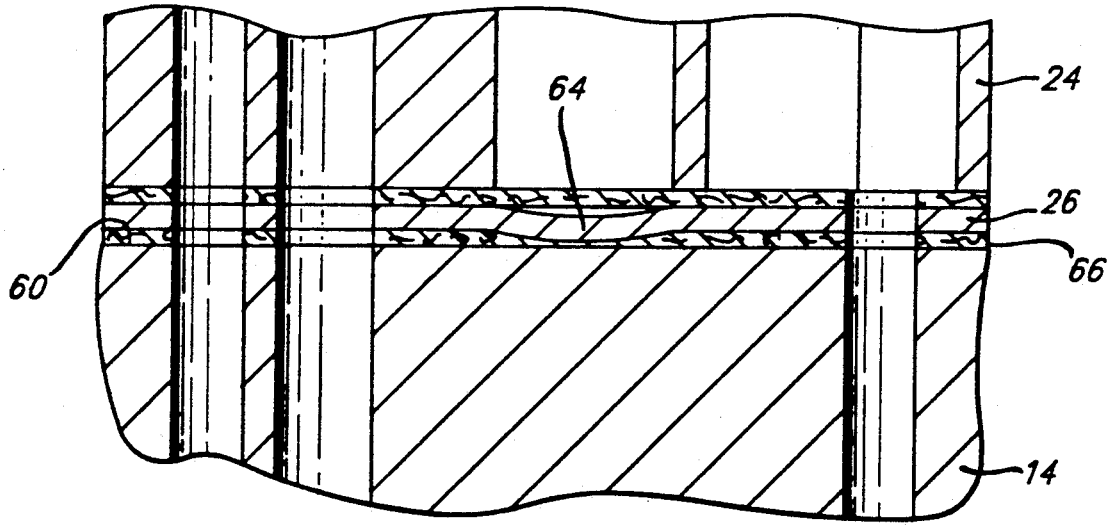
FIG. 5 is a section view of the valve plate assembly of FIG. 2 shown in operative relationship to portions of the head and compressor housing which are also shown in section, the section being taken along line 5—5 of FIG. 2.

In order to prevent possible fluid leakage between discharge chamber 42 and suction chamber 50, valve plate 26 incorporates a section 58 which is bowed outwardly in the direction toward head 24 as best seen with reference to FIG. 4. Bowed section 58 has an overall length approximately equal to the distance between the sidewalls of cylinder 18 as indicated by points A and B in FIGS. 2 and 4 with a maximum height approximately at point C or midway between points A and B. As shown in FIGS. 2 and 4, this bowed area will span that area in which valve plate assembly overlies the discontinuity caused by the cylinder bore in the otherwise substantially planar surface 60 of compressor housing 14 and hence is not supported thereby. The raised surface caused by bowed portion 58 serves to cooperate with the opposed surface of wall 52 to initially exert a greater compressive force on gasket 62 within this area as compared to other areas wherein the valve plate is fully supported by surface 60. Thus, greater assurance is provided that a secure fluid tight seal will be created and maintained between valve plate assembly 26 and head 24 and thus any potential leakage between the suction and discharge chamber 50 and 42 will b avoided.

In the present embodiment, a substantially identically bowed area 58' as bowed portion 58 will also be provided in the area where valve plate assembly 26 overlies cylinder 18. This portion has been indicated by the same numbers and letters primed in FIG. 2.

In the embodiment illustrated, there also exists an area wherein the valve plate is unsupported due to discontinuities in the planar surface of the head 24, such discontinuities resulting from the open cavities forming the suction and discharge chambers 42 and 50. Accordingly, valve plate 27 includes an area 64 extending approximately between points D and E wherein valve plate 27 is bowed in a direction toward compressor housing 14 so as to provide a raised surface area which will cooperate with surface 60 to initially increase the clamping force exerted on gasket 66 disposed therebetween. As shown in FIG. 2, the area in which this raised or bowed portion 64 is located corresponds to the surface are between the adjacent cylinders and the area of the head in which the discharge chamber 42 is located. This represents an area for possible leakage both due to the fact the two pistons will be designed to compress in alternating relationship and thus one cylinder may be at suction pressure while the other cylinder is at discharge pressure and the fact the head does not have any wall portion directly overlying this area to reinforce the valve plate due to the presence of discharge chamber 42. However, by bowing the valve plate within this area, sufficient clamping force will be provided to maintain the desired sealing relationship irrespective of thermal and/or pressure distortions to which the valve plate may be subjected.

It should be noted that the localized bowing of the valve plate as described above offers greater freedom in the design of the cylinder head and associated suction and discharge chambers as well as facilitating the use of thinner valve plates which, as noted above, result in improved compressor volumetric efficiency. Further, in some cases it is possible to achieve the requisite clamping force to insure proper sealing with fewer more widely spaced fasteners which also reduces costs and improves design flexibility.

While it will be apparent that the preferred embodiment of the present invention disclosed is well calculated to provide the advantages and features above stated, it will be appreciated that the invention is susceptible to modification, variation and change without departing from the proper scope or fair meaning of the subjoined claims.

I claim:

1. A refrigeration compressor comprising:

a cylinder block defining a compression chamber;

a valve plate overlying said compression chamber and including suction valve means and discharge valve means for controlling fluid flow to and from said compression chamber;

a head secured to said cylinder block and clamping said valve plate therebetween, said head including means defining a suction chamber and discharge chamber;

gasket means clamped between said valve plate and said head for creating a sealing relationship therebetween;

and means on said valve plate for increasing the clamping force exerted on said gasket means in a predetermined area to thereby insure a fluid tight seal therebetween, said predetermined area being positioned in overlying relationship to said compression chamber.

2. A refrigeration compressor as set forth in claim 1 wherein said means for increasing said clamping force comprises a raised portion provided on the surface of said valve plate in said preselected area.

3. A refrigeration compressor as set forth in claim 2 wherein said valve plate is of substantially uniform thickness and said raised portion is formed by bowing said valve plate in said preselected area.

4. A refrigeration compressor as set forth in claim 1 wherein said valve plate includes first and second suction passages extending therethrough for enabling fluid flow from said suction chamber to said compression chamber and first and second suction valves secured to said valve plate in overlying relationship to said first and second suction passages respectively, the portion of said first suction valve which is secured to said valve plate being located remotely from the portion of said second suction valve which is secured to said valve plate.

5. A refrigeration compressor as set forth in claim 4 wherein said second suction valve has a free end, said secured portion of said first suction valve being located adjacent said free end.

6. A valve plate for refrigeration compressor for controlling flow of refrigerant gas to and from compressor means, said compressor including a head and a compressor housing, said valve plate being adapted to be clamped between said head and said compressor housing, said valve plate including oppositely facing first and second surfaces, said first surface having a raised portion formed thereon in a preselected area adapted to cooperate with one of said head and said compressor housing to initially increase the clamping force exerted in said preselected area to thereby maintain a fluid tight seal between said valve plate and said one of said housing and said head, said preselected area being positioned so as to correspond to a discontinuity in the surface of the other of said head and said compressor housing disposed on the side of said valve plate opposite the side on which said clamping force increasing means is acting when said valve plate is clamped between said head and said compressor housing.

7. A valve plate as set forth in claim 6 wherein said second surface includes a raised portion in a second preselected area spaced from said preselected area, said second raised portion being operative to initially increase the clamping force exerted in said second preselected area, the other of said head and said compressor housing to thereby maintain a fluid tight seal therebetween.

8. A valve plate as set forth in claim 7 wherein said valve plate is of substantially uniform thickness and said raised portion and said second raised portion are formed by bowing said valve plate.

9. A refrigeration compressor comprising:

a compressor housing having a substantially planar surface through which a cylinder bore opens;

a head having a substantially planar surface positioned in opposed facing relationship to said planar surface of said compressor housing, said head having a cavity formed therein opening outwardly at said planar surface and wall means dividing said cavity into suction and discharge chambers, said wall having an outer surface positioned in substantially coplanar relationship with said planar surface of said head;

a valve plate positioned between said compressor housing and said cylinder head, said valve plate having first and second surfaces positioned in opposed facing relationship to said substantially planar surfaces of said compressor housing and said head respectively;

first gasket means disposed between said first surface of said valve plate and said compressor housing planar surface and second gasket means disposed between said second surface of said valve plate and said head planar surface;

means securing said head and said valve plate to said compressor housing and exerting a clamping force on said first and second gasket means; and said valve plate including means for increasing the clamping force exerted on said second gasket means in a preselected area positioned in overlying relationship to said cylinder bore.

10. A refrigeration compressor as set forth in claim 9 wherein said outer surface of said wall means extends through said preselected area.

11. A. refrigeration compressor as set forth in claim 9 wherein said means for increasing said clamping force comprises a raised portion provided on said second surface of said valve plate in said preselected area.

12. A refrigeration compressor as set forth in claim 11 wherein said valve plate is of substantially uniform thickness and said raised portion is formed by bowing said valve plate in said preselected area.

13. A refrigeration compressor as set forth in claim 9 wherein said compressor housing includes a second cylinder bore spaced from said cylinder bore and opening outwardly through said substantially planar surface, said head, said valve plate and said first and second gasket means also extending in overlying relationship to said second cylinder bore, and means for increasing the clamping force on said first gasket means in the area between said cylinder bore and said second cylinder bore.

14. A refrigeration compressor as set forth in claim 13 wherein said means for increasing said clamping force comprises a raised portion on said valve plate formed by bowing said valve plate in said area.

15. A refrigeration compressor as set forth in claim 9 wherein said valve plate includes first and second suction passages for placing said suction chamber in communication with said cylinder bore and first and second elongated suction valves having opposite ends secured to said valve plate to control fluid flow through said suction passages.

16. A refrigeration compressor as set forth in claim 15 wherein said suction valves are positioned in generally parallel spaced relationship.

17. A system for insuring a fluid tight seal comprising:

a first member having a substantially planar surface, said surface having discontinuities thereon;

a second member having a substantially planar surface, said surface having discontinuities thereon;

a third member having oppositely facing first and second surfaces, respective ones of said first and second surfaces being positioned in opposed facing relationship with respective ones of said substantially planar surfaces of said first and second members;

gasket means disposed between one of said first and second surfaces of said third member and a corresponding facing surface of one of said first and second member;

means securing said first, second and third members together whereby a clamping pressure is exerted on said gasket means; and first means provided on one of said surfaces of said first, second and third members to increase the clamping force exerted on said gasket means in a preselected area between said one surface of said third member and said corresponding facing surface, said preselected area corresponds to an area in which the other of said first and second surfaces of said third member overlies one of said discontinuities in the corresponding facing surface of the other of said first and second members.

18. A system as set forth in claim 17 wherein said first means for increasing said clamping force comprise a raised portion provided on said one of said first and second surfaces of said third member in said preselected area.

19. A system as set forth in claim 18 wherein said third member is of substantially uniform thickness and said raised portion is provided by bowing said third member in said preselected area.

20. A system as set forth in claim 17 further comprising second gasket means disposed between the other of said first and second surfaces of said third member and the corresponding facing surface of the other of said first and second members, said gasket having a clamping force exerted thereon and said third member includes second means to increase the clamping force exerted on said second gasket means in a second preselected area.

21. A system as set forth in claim 20 wherein said third member is of substantially uniform thickness and said first and second means for increasing the clamping force on said first and second gasket means are provided by bowing said third member in one direction in said preselected area and bowing said third member in an opposite direction in said second preselected area.

22. A system as set forth in claim 21 wherein said second preselected area corresponds to another area of said third member overlying one of said discontinuities in said surface of said one of said first and second members.

23. A refrigeration compressor comprising:

a compressor housing having a substantially planar surface through which a cylinder bore opens;

a head having a substantially planar surface positioned in opposed facing relationship to said planar surface of said compressor housing, said head having a cavity formed therein opening outwardly at said planar surface and wall means dividing said cavity into suction and discharge chambers, said wall having an outer surface positioned in substantially coplanar relationship with said planar surface of said head;

a valve plate positioned between said compressor housing and said cylinder head, said valve plate having first and second surfaces positioned in opposed facing relationship to said substantially planar surfaces of said compressor housing and said head respectively;

first gasket means disposed between said first surface of said valve plate and said compressor housing planar surface and second gasket means disposed between said second surface of said valve plate and said head planar surface;

means securing said head and said valve plate to said compressor housing and exerting a clamping force on said first and second gasket means; and one of said valve plate, said compressor planar surface and said head planar surface including means for increasing the clamping force exerted on said second gasket means in a preselected area, said preselected area corresponding to an area of the other of said head planar surface and compressor planar surface in which said cavity opens outwardly of said cylinder bore opens.

* * * * *

UNITED STATES PATENT AND TRADEMARK OFFICE

CERTIFICATE OF CORRECTION

PATENT NO. : 5,073,146

DATED : December 17, 1991

INVENTOR(S) : Norman G. Beck

It is certified that error appears in the above-identified patent and that said Letters Patent is hereby corrected as shown below:

Column 3, line 64, "b" should be -- be --.

Column 4, line 16, "are" should be -- area --.

Column 5, line 22, after "for" insert -- a --.

Column 8, line 37, "of" should be -- or --.

Signed and Sealed this

First Day of June, 1993

*Attest:*

Michael K. Kirk

MICHAEL K. KIRK

*Attesting Officer*

*Acting Commissioner of Patents and Trademarks*